US008690589B2

(12) United States Patent
Ngo

(10) Patent No.: US 8,690,589 B2
(45) Date of Patent: Apr. 8, 2014

(54) ELECTRICAL CARD-EDGE CONNECTOR

(75) Inventor: Hung Viet Ngo, Harrisburg, PA (US)

(73) Assignee: FCI Americas Technology LLC, Carson City, NV (US)

( * ) Notice: Subject to any disclaimer, the term of this patent is extended or adjusted under 35 U.S.C. 154(b) by 102 days.

(21) Appl. No.: 13/113,840

(22) Filed: May 23, 2011

(65) Prior Publication Data

US 2011/0300759 A1 Dec. 8, 2011

Related U.S. Application Data

(60) Provisional application No. 61/352,231, filed on Jun. 7, 2010.

(51) Int. Cl.
*H01R 12/00* (2006.01)

(52) U.S. Cl.
USPC ..... 439/79; 439/630

(58) Field of Classification Search
USPC ..... 439/79, 80, 328, 377, 630, 637, 572
See application file for complete search history.

(56) References Cited

U.S. PATENT DOCUMENTS

| | | | | |
|---|---|---|---|---|
| 3,351,894 | A | 11/1967 | Kinkaid | |
| 4,695,112 | A | 9/1987 | Maston et al. | |
| 4,717,218 | A * | 1/1988 | Ratcliff | 439/59 |
| 4,781,612 | A * | 11/1988 | Thrush | 439/630 |
| 5,429,525 | A | 7/1995 | McCoy | |
| 5,644,839 | A | 7/1997 | Stone | |
| 5,897,386 | A * | 4/1999 | Baxter et al. | 439/79 |
| 5,971,775 | A | 10/1999 | Tor et al. | |
| 6,341,988 | B1 * | 1/2002 | Zhu et al. | 439/630 |
| 7,014,475 | B1 | 3/2006 | Mongold | |
| D540,264 | S | 4/2007 | Zhang | |
| D606,496 | S | 12/2009 | Ngo | |
| D606,497 | S | 12/2009 | Ngo | |
| D608,293 | S | 1/2010 | Ngo | |
| D610,548 | S | 2/2010 | Ngo | |
| D621,364 | S | 8/2010 | Kasahara | |
| D623,138 | S | 9/2010 | Ngo | |
| D639,246 | S | 6/2011 | Ngo | |
| D640,201 | S | 6/2011 | Ngo | |
| D641,321 | S | 7/2011 | Ngo | |
| D668,613 | S | 10/2012 | Ngo | |
| 2003/0224654 | A1 | 12/2003 | Wu | |
| 2010/0112834 | A1 | 5/2010 | Chen et al. | |
| 2010/0124848 | A1 | 5/2010 | Atkinson et al. | |
| 2010/0184339 | A1 | 7/2010 | Ngo et al. | |
| 2011/0151701 | A1 | 6/2011 | Ngo | |

OTHER PUBLICATIONS

U.S. Appl. No. 12/687,237, filed Jan. 14, 2010, Ngo.
U.S. Appl. No. 13/113,818, filed May 23, 2011, Ngo.
U.S. Appl. No. 13/113,840, filed May 23, 2011, Ngo.
U.S. Appl. No. 13/113,847, filed May 23, 2011, Ngo.

(Continued)

*Primary Examiner* — Khiem Nguyen
(74) *Attorney, Agent, or Firm* — Baker & Hostetler LLP

(57) ABSTRACT

A card-edge connector has a housing that includes a housing body, and a plurality of electrical contacts carried by the housing body. The electrical contacts include a plurality of electrical signal contacts and a plurality of electrical power contacts. The electrical signal contacts are sized thinner than the electrical power contacts. The card-edge connector includes a mounting fastener extending out from only one side wall of the housing body at a location adjacent the electrical signal contacts.

18 Claims, 8 Drawing Sheets

(56) References Cited

OTHER PUBLICATIONS

U.S. Appl. No. 29/363,270, filed Jun. 7, 2010, Ngo.
U.S. Appl. No. 61/205,276, filed Jan. 16, 2009, Ngo.
U.S. Appl. No. 61/352,231, filed Jun. 7, 2010, Ngo.
U.S. Appl. No. 61/352,245, filed Jun. 7, 2010, Ngo.

* cited by examiner

ELECTRICAL CARD-EDGE CONNECTOR

CROSS-REFERENCE TO RELATED APPLICATIONS

This application claims the benefit of U.S. Provisional Patent Application Ser. No. 61/352,231, filed on Jun. 7, 2010, the disclosure of which is hereby incorporated by reference as if set forth in its entirety herein.

This application is related by subject matter to U.S. Design patent application Ser. No. 29/363,267 filed on Jun. 7, 2010, U.S. Utility patent application entitled "Electrical Card-Edge Connector" filed on even date, U.S. Design patent application Ser. No. 29/363,269 filed on Jun. 7, 2010, and U.S. Design patent application Ser. No. 29/363,270 filed on Jun. 7, 2010. The disclosures of all of the above-related patent applications are hereby incorporated by reference as if set forth in their entireties herein.

BACKGROUND

Electrical connector assemblies generally include circuits and components on one or more circuit boards that are connected together by an electrical connector. Examples of electrical components in an electrical connector assembly can include daughter boards, motherboards, backplane boards, midplane boards, or the like. The electrical connector provides an interface between electrical components, and provides electrically conductive paths for electrical communications data signals and/or electrical power.

For instance, referring to FIG. 1, one example conventional electrical assembly 20 includes a card-edge connector 22 connected between a first circuit board 24 and a second circuit board 26. The card-edge connector 22 is illustrated as a straddle-mount style card-edge connector that provides an electrically conductive path between traces at an edge of the first printed circuit board 24 and traces at an edge of the second printed circuit board 26, which is illustrated as being co-planar with the first printed circuit board 24. Such a configuration may be well suited for an electrical assembly in an enclosure, such as a 1U rack-mount server.

The card-edge connector 22 includes a connector housing 28 having a housing body 29 that carries a plurality of electrical contacts 30, which can include electrical signal contacts 32 and electrical power contacts 34. The card-edge connector 22 defines a mounting interface 36 that receives an edge of the first printed circuit board 24, and a mating interface 38 that receives the second printed circuit board 26. The first printed circuit board 24 includes a plurality of electrical contact pads 40 that are connected to the electrical contacts 30 of the card-edge connector 22 when the first printed circuit board 24 is mated to the card-edge connector 22. The electrical contacts 30 and the electrical contact pads 40 are then typically soldered to establish a permanent electrical connection between the electrical contacts 30 of the card-edge connector 22 and the first printed circuit board 24.

The second printed circuit board 26 can be inserted into the mating interface 38 of the edge-card connector 22 so that electrical contact pads 42 of the second printed circuit board 26 are brought into contact with the electrical contacts 30, thereby establishing an electrical connection between the electrical traces of the first printed circuit board 24 and the electrical contacts 30 of the card-edge connector. It should thus be appreciated that the card-edge connector 22 can be electrically connected to the first and second circuit boards 24 and 26 so as to place the first and second circuit boards 26 in electrical communication. The second printed circuit board 26 can be removed from the mating interface 38 of the card-edge connector 22 and re-inserted into the mating interface 38, or another circuit board can be inserted into the mating interface 38 as desired. In this regard, the first printed circuit board 24 can be referred to as a host board, and the second printed circuit board 26 can be referred to as an edge card that can be placed in removable electrical communication with the host board.

The card-edge connector 22 includes a pair of mounting ears 44 that extend out from opposed sides of the housing body 29, and present apertures that are placed in alignment with corresponding apertures on the first printed circuit board 24 when the electrical contacts 30 are placed in contact with the electrical contact pads 40. The aligned apertures are configured to receive hardware 46, such as screws, nuts, and the like, so as to provide a secure physical connection between the card-edge connector 22 and the first printed circuit board 24. Accordingly, when the second printed circuit board 26 is mated to the card-edge connector 22, stresses applied to the card-edge connector 22 from the second printed circuit board that would be absorbed by the connection between the electrical contacts 30 and the electrical contact pads 40 are at least partially absorbed by the secure physical connection between the card-edge connector 22 and the first printed circuit board 24. Unfortunately, the mounting ears 44 occupy valuable real estate on the first printed circuit board 24.

SUMMARY

In accordance with one embodiment, a card-edge connector is configured to receive a first substrate having a first mounting aperture. The card-edge connector includes a connector housing having a housing body that carries a plurality of electrical contacts. The electrical contacts define a mounting end configured to be electrically connected to the first substrate, and an opposed mating end configured to be electrically connected to a second substrate. The connector further includes a mounting fastener extending out from the housing body, the mounting fastener configured to engage the first mounting aperture. The card-edge connector further includes a mounting guide formed in the housing body, the mounting guide configured to receive a side edge of the first substrate when the card-edge connector is mounted to the first substrate.

BRIEF DESCRIPTION OF THE DRAWINGS

The foregoing summary, as well as the following detailed description of an example embodiment of the application, will be better understood when read in conjunction with the appended drawings. For the purposes of illustrating the flexible anchoring keel and related instruments of the present application, there is shown in the drawings an example embodiment. It should be understood, however, that the application is not limited to the precise arrangements and instrumentalities shown. In the drawings.

DETAILED DESCRIPTION

Figure 2A:
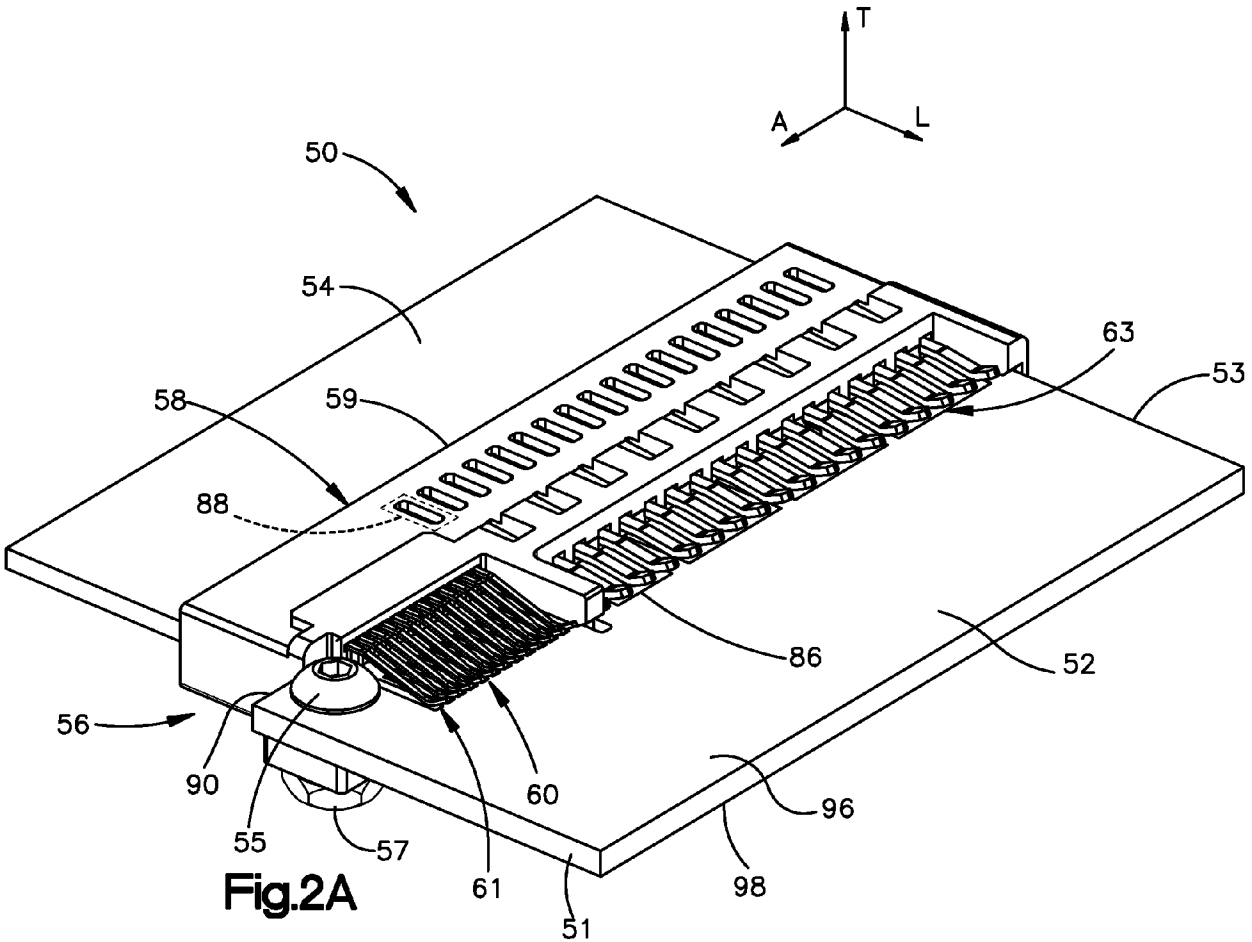
FIG. 2A is a perspective view of an electrical connector assembly including a first circuit board, a second circuit board, and an electrical connector connected between the first and second circuit boards, the electrical connector including a mounting fastener.
Figure 2B:
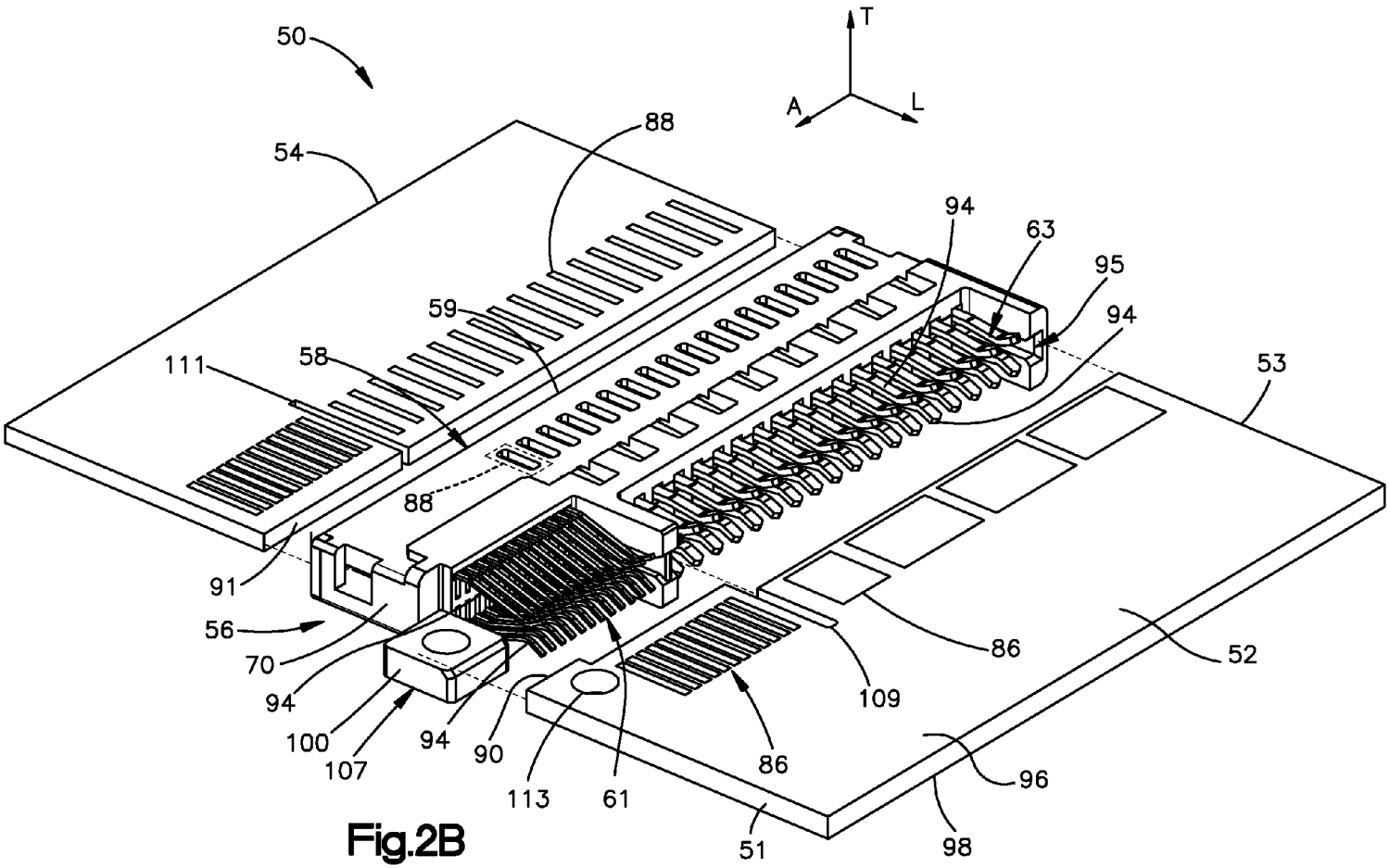
FIG. 2B is an exploded perspective view of the electrical connector assembly as illustrated in FIG. 2A.

Referring to FIGS. 2A-B, an electrical connector assembly 50 includes a first substrate such as a first printed circuit board (PCB) 52, a second substrate such as a second printed circuit board (PCB) 54, and an electrical connector 56 configured to be electrically connected between the first and second substrates 52 and 54, respectively, so as to place the first printed circuit board 52 in electrical communication with the second printed circuit board 54. The electrical connector 56 is illustrated as a card-edge connector, and can be configured as a straddle-mount connector in accordance with one embodiment as is described in more detail below.

The electrical connector 56 includes a dielectric or electrically insulative connector housing 58 that can be made of any suitable dielectric material, including a plastic, such as a high temperature thermoplastic. The connector housing 58 includes a housing body 59 that carries one or more electrical contacts 60 configured to engage complementary electrical traces on the first and second circuit boards 52 and 54, respectively. In particular, the connector housing 58 defines a mounting interface 62 and a mating interface 64 separated along a longitudinal direction L. The mounting interface 62 is configured to electrically and physically connect to the first printed circuit board 52, and the mating interface 64 is configured to electrically and physically connect to the second printed circuit board 54. The electrical contacts 60 can extend between the mounting interface 62 and the mating interface 64, so as to electrically connect to the first printed circuit board 52 when the electrical connector 56 is mounted to the first printed circuit board 52, and so as to electrically connect to the second printed circuit board 54 when the electrical connector 56 is mated to the second printed circuit board 54. In accordance with one embodiment, the mounting interface 62 can be configured as a straddle-mount interface whereby the electrical contacts 60 straddle the first printed circuit board 52 when the electrical connector 56 is mounted to the first printed circuit board 52. Thus, the connector housing 58 can be referred to as a straddle-mount card-edge housing in accordance with the illustrated embodiment. The electrical connector 56 can be referred to as a card-edge connector, and in particular can be referred to as a straddle-mount connector.

Figure 3:
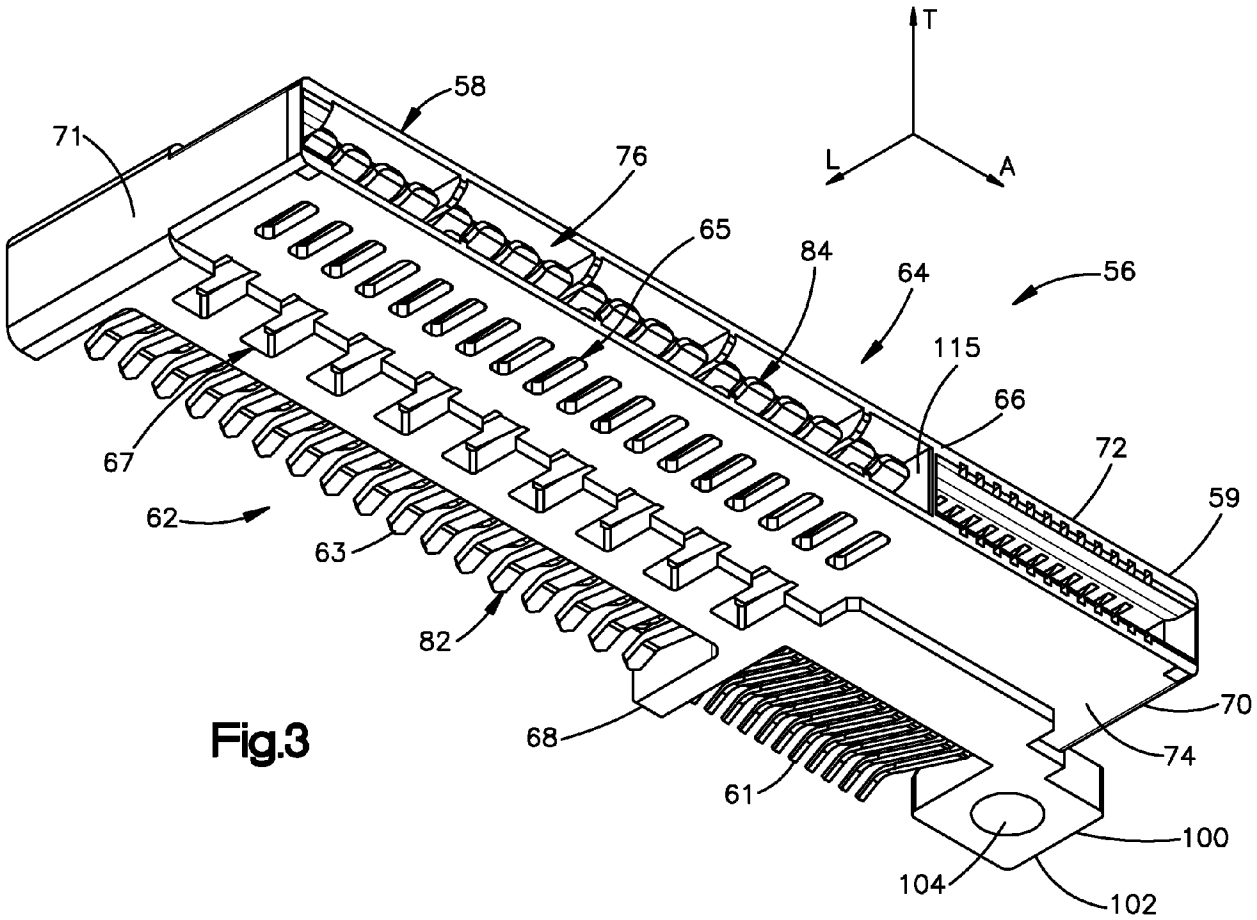
FIG. 3 is a bottom front perspective view of the electrical connector illustrated in FIG. 2.
Figure 4:
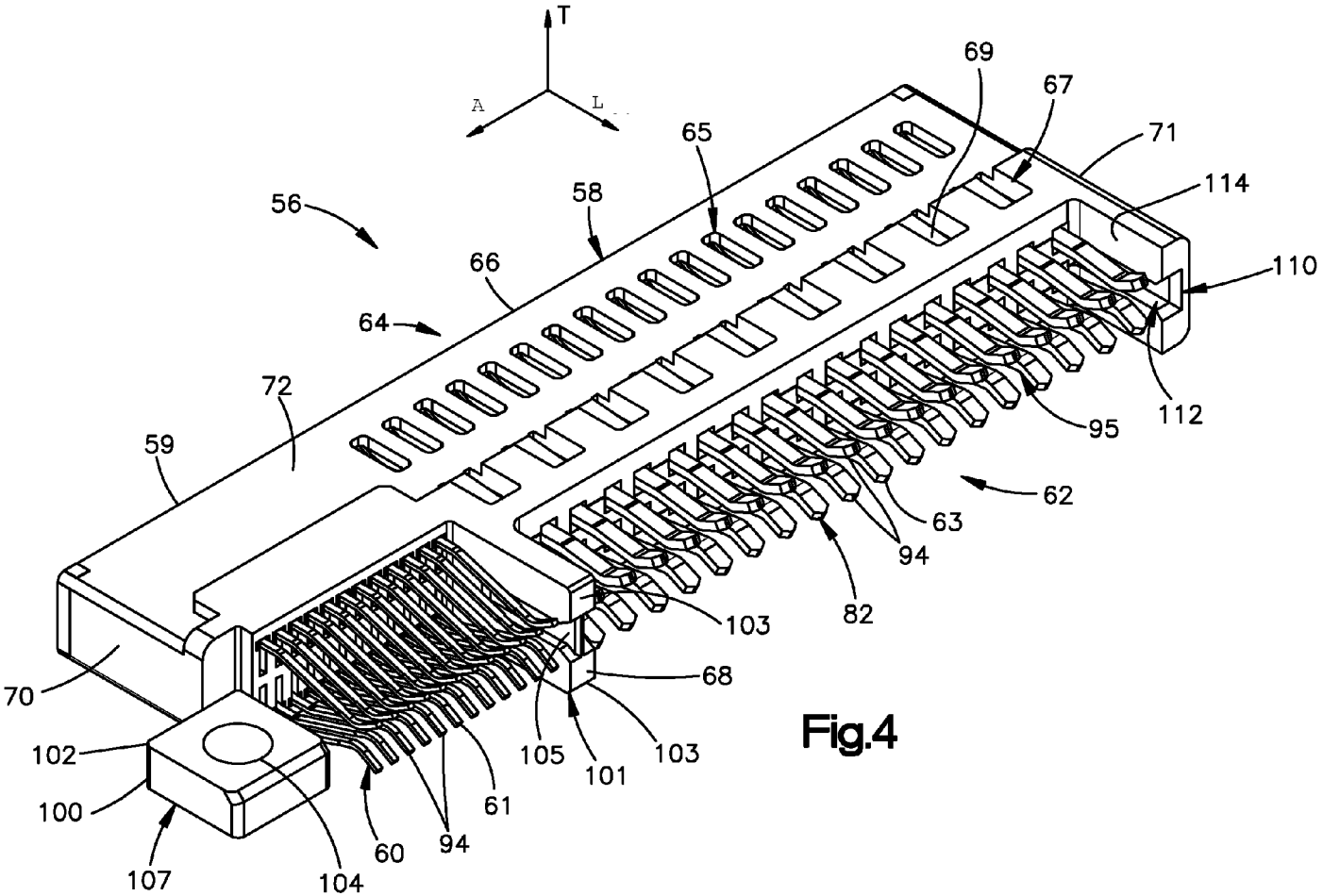
FIG. 4 is a top rear perspective view of the electrical connector illustrated in FIG. 2.

Referring now to FIGS. 3-4, the housing body 59 defines a front end 66 and a rear end 68 spaced from the front end 66 along the longitudinal direction L. The front end 66 is disposed proximate to the mating interface 64 and the rear end 68 is disposed proximate to the mounting interface 62. The housing body 59 further defines a first side wall 70 and an opposed second side wall 71 separated from the first side wall 70 along a lateral direction that extends in a lateral direction A that is substantially perpendicular to the longitudinal direction L. The first and second side walls 70 and 71 extend between the mating interface 64 and the mounting interface 62. The housing body 59 is elongate along the lateral direction A, and individual ones of the electrical contacts 60 are spaced along the lateral direction A. The housing body 59 further defines an upper end 72 and an opposed lower end 74 that is spaced from the upper end 72 along a transverse direction T that is substantially perpendicular to both the longitudinal direction L and the lateral direction A. The longitudinal and lateral directions L and A, respectively, extend horizontally and the transverse direction T extends vertically as illustrated, though it should be appreciated that the orientation of the electrical connector 56 can vary during operation.

Figure 5:
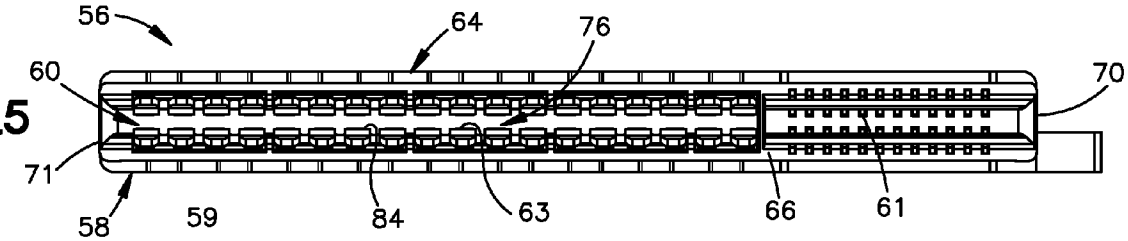
FIG. 5 is a front elevation view of the electrical connector illustrated in FIG. 2.

As also illustrated in FIG. 5, the connector housing 58 includes a chamber 76 that is defined by the housing body 59. The electrical contacts 60 are carried by the housing 58 such that the electrical contacts 60 are at least partially disposed in the chamber 76. The chamber 76 can be open to the mating interface 64, and can be configured to receive the second printed circuit board 54 so as to mate the electrical connector 56 to the second printed circuit board 54. The chamber 76 can be open or partially closed to the mounting interface 62. For instance, the housing body 59 can include a rear wall 78 that partially closes the chamber 76 at the mounting interface 62. The housing body 59 can define a plurality of apertures 80 that extend through the rear wall 78, such that the electrical contacts 60 extend through respective ones of the apertures 80.

The electrical contacts 60 can be made of any suitable electrically conductive material as desired, such as a copper alloy. The electrical contacts 60 can include a plurality of electrical signal contacts 61 that are sized and configured to transmit electrical communications or data signals between the first and second substrates 52 and 54, and a plurality of electrical power contacts 63 that are sized and configured to transmit power, such as DC and/or AC power, between the first and second substrates 52 and 54. Thus, the electrical power contacts 63 can be sized larger than the electrical signal contacts 61 so as to support DC and/or AC power. For instance, the electrical power contacts 63 can have a thickness (e.g., in one or both of the lateral and longitudinal directions) that is greater than that of the electrical signal contacts 61. In accordance with the illustrated embodiment, the electrical contacts 60 can be arranged such that the electrical signal contacts 61 are disposed laterally adjacent the electrical power contacts 63. For instance, the electrical signal contacts 61 can be disposed adjacent one of the side walls of the housing body 59, such as the first side wall 70 as illustrated. Individual ones of the electrical signal contacts 61 can be spaced laterally such that the electrical signal contacts 61 are arranged laterally inward from the first side wall 70 toward the second side wall 71. The electrical power contacts 63 can be disposed adjacent the opposite one of the side walls with respect to the side wall that is adjacent the electrical signal contacts 61. In accordance with the illustrated embodiment, the electrical power contacts 63 are disposed adjacent the second side wall 71. Individual ones of the electrical power contacts 63 can be spaced laterally such that the electrical power contacts 63 are arranged laterally inward from the second side wall 71 toward the first side wall 70.

Referring to FIGS. 2A-4 and FIGS. 7-8, the connector housing 58 can include at least one lateral row of apertures such as first and second lateral rows of apertures 65 and 67 that extend transversely through the upper and lower ends 74 and 72 of the housing body 59. The first row of apertures 65 can be disposed proximate to the mating interface 64, and the second row of apertures 67 can be disposed proximate to the mounting interface 62. The first row of apertures 65 can be aligned with the electrical power contacts 63 so as to facilitate the dissipation of heat from the connector housing 58. Heat can be generated as electrical power is transmitted along the electrical power contacts 63 during operation of the electrical connector assembly 50. The electrical connector 58 can include tabs 69 that extend into respective ones of the second row of apertures 67 and are configured to latch onto the electrical power contacts 63 so as to assist in securing the electrical power contacts 63 in the connector housing 58.

Each of the electrical contacts 60, including the electrical signal contacts 61 and the electrical power contacts 63, can define respective mounting ends 82 and opposed mating ends 84 that are longitudinally spaced from the mounting ends 82. The mounting ends 82 are operatively associated with the mounting interface 62 such that the mounting ends 82 electrically connect to the contact pads 86 of the first printed circuit board 52 when the electrical connector 56 is mounted to the first printed circuit board 52. The mating ends 84 are operatively associated with the mating interface 64 such that the mating ends 84 electrically connect to the contact pads 88 of the second printed circuit board 54 when the electrical connector 56 is mated to the second printed circuit board 54. Accordingly, when the electrical connector 56 is attached to the first and second circuit boards 52 and 54, respectively, an electrically conductive path may be established from and between the electrical contact pads 86 on the first printed circuit board 52, through respective electrical contacts 60, and respective electrically contact pads 88 of the second printed circuit board 54. The first and second circuit board 52 and 54 each also carry electrical traces that are electrically connected to the respective electrical contact pads 86 and 88.

The electrical contact pads 86 are disposed proximate to a leading edge 90 of the first printed circuit board 52, and the electrical contact pads 88 are disposed proximate to a leading edge 91 of the second printed circuit board 54. When the electrical connector 22 is mounted onto the first printed circuit board 52, the side walls 70 of the housing body 59 are illustrated as elongate in a direction substantially perpendicular with respect to the leading edge 90 of the first printed circuit board 52. Likewise, when the electrical connector 22 is mated to the second printed circuit board 54, the side walls 70 of the housing body 59 are illustrated as elongate in a direction substantially perpendicular with respect to the leading edge 91 of the second printed circuit board 54.

The mating ends 84 of the electrical contacts 60, including the electrical signal contacts 61 and the electrical power contacts 63, can be carried within the housing body 59, for instance in the chamber 76, and include respective transversely opposed prongs that are configured to straddle the leading edge of the second printed circuit board 54 when the second printed circuit board 54 is inserted into the chamber 76 at the mating interface 64 so as to mate the electrical connector 56 and the second printed circuit board 54. The mounting ends 82 of the electrical contacts 60, including the electrical signal contacts 61 and the electrical power contacts 63, can extend through the rear wall 78 of the housing body 59. As illustrated in FIG. 4, each respective mounting end 82 may include opposing prongs 94 that define a gap 95 therebetween, and present flared distal ends that can provide guidance when mounting the electrical connector 56 to the first printed circuit board 52. The prongs 94 can be arranged in first and second rows, such as upper and lower rows, that are configured to straddle the first printed circuit board when the electrical connector 56 is mounted to the first printed circuit board.

As illustrated in FIG. 2B, when the electrical connector 56 is attached to the first printed circuit board 52, the opposing prongs 94 straddle the leading edge 90 of the circuit board 52, which is inserted into the gap 95. The contact pads 86 may be disposed on a top surface 96 and/or a bottom surface 98 of the first printed circuit board 52, and may be sized so as to electrically connect to individual ones of the electrical contacts 60, or can be sized to electrically connect to more than one of the electrical contacts 60. For instance, in accordance with the illustrated embodiment, one or more up to all of the contact pads 86 can be sized to electrically connect to individual ones of the electrical signal contacts 61. Furthermore, in accordance with the illustrated embodiment, one or more up to all of the contact pads 86 can be sized to electrically connect to more than one of the electrical power contacts 63, though it should be appreciated that one or more, up to all, of the contact pads 86 can be sized so as to electrically connect to individual ones of the electrical power contacts 63. Thus, when the electrical connector 56 is attached to the first printed circuit board 52, the mounting ends 82 of the electrical contacts 60 may pinch the top surface 96 and bottom surface 98 of the first printed circuit board 52 and establish an electrically conductive path from the electrical contacts 60 to the contact pads 86 and the respective electrical traces that are carried by the first printed circuit board 52.

The electrical connector 56 can be attached to the first printed circuit board 52 by imparting a relative longitudinal motion on at least one of the connector 56 and circuit board 52 along a longitudinal insertion direction such that the mounting interface 62 of the electrical connector 56 receives the leading edge 90 of the circuit board 52 until the electrical contacts 60 engage the contact pads 86. The electrical contacts 60 can then be soldered to the contact pads 86 as desired so as to permanently secure the first printed circuit board 52 to the electrical connector 56. In this regard, the first printed circuit board 52 can be referred to as a host board.

Figure 6:
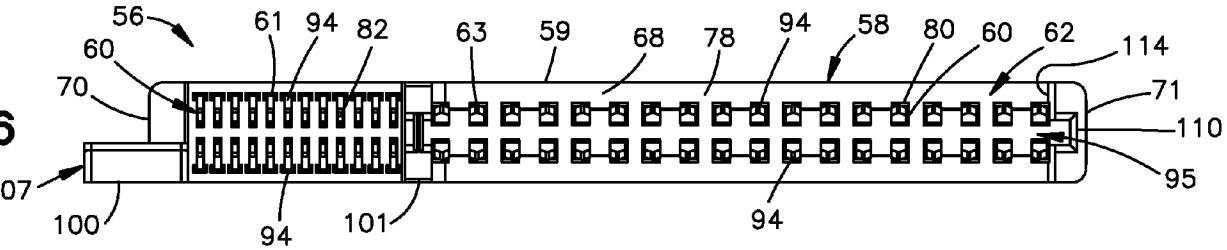
FIG. 6 is a rear elevation view of the electrical connector illustrated in FIG. 2.
Figure 7:
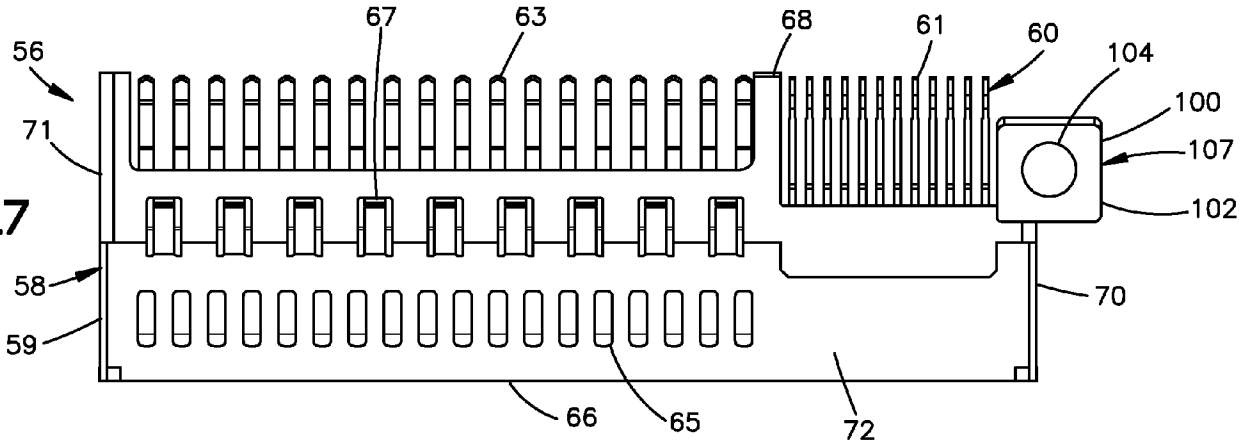
FIG. 7 is a top plan view of the electrical connector illustrated in FIG. 2.
Figure 8:
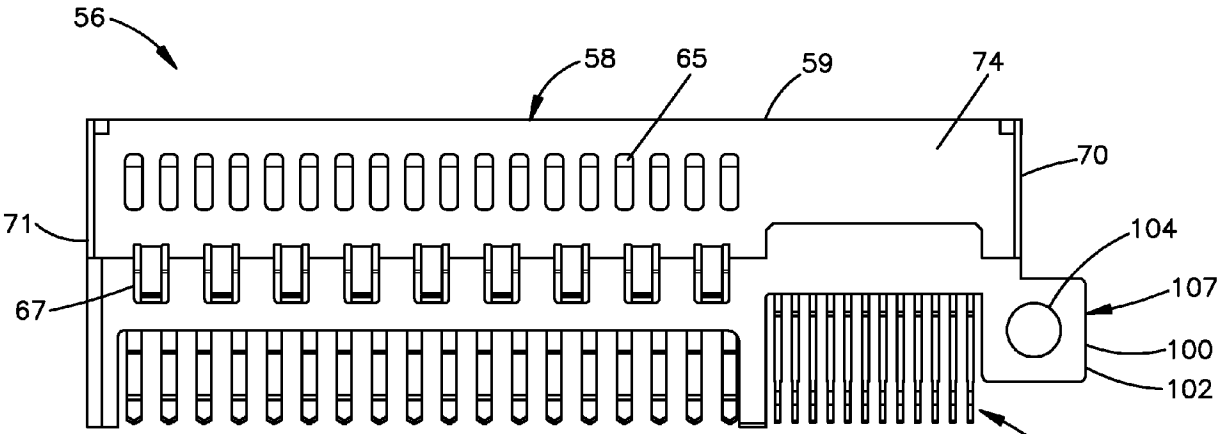
FIG. 8 is a bottom plan view of the electrical connector illustrated in FIG. 2.

As illustrated in FIGS. 4 and 6, the connector housing 58 can include a polarization member in the form of a polarization wall 101 that extends transversely between the upper end 72 and the lower end 74 at a location laterally between the signal contacts 61 and the power contacts 63 at the mounting end 62. The polarization wall 101 is thus disposed at a location offset with respect to a laterally central location of the housing body 59. The first printed circuit board 52 can define a slot 109 (see FIG. 2B) that extends longitudinally in from the leading edge 90 and is sized so as to receive the polarization wall 101, thereby ensuring that the first printed circuit board 52 is properly oriented for connection to the electrical connector 56. In particular, the electrical pads 86 that are configured to engage the signal contacts 61 in fact engage the signal contacts 61 when the electrical connector 56 is mounted to the first printed circuit board 52, and the electrical pads 86 that are configured to engage the power contacts 63 in fact engage the power contacts 63 when the electrical connector 56 is mounted to the first printed circuit board 52.

Furthermore, the polarization wall 101 can include opposed outer portions 103, illustrated as opposed upper and lower portions, and a middle portion 105 disposed between the opposed outer portions 103. The opposed outer portions 103 can have a lateral thickness greater than the middle portion 105. For instance, the lateral thickness of the opposed outer portions 103 can be greater than that of the slot 109 extending into the leading edge 90. The lateral thickness of the middle portion 105 can be sized substantially equal to or less than that of the slot 109 such that the middle portion 105 is configured to be received in the slot 109. The middle portion 105 can define a transverse dimension or height equal to that of the first printed circuit board 52 such that the first printed circuit board 52 can be substantially captured between the upper and lower portions 103 so as to facilitate engagement of the contact pads 86 and the electrical contacts 60.

The middle portion 105 is aligned with the gap 95 between the prongs 94 of the mounting ends 82 of the electrical contacts 60. Accordingly, the middle portion 105 of the polarization wall 101 provides an alignment guide that causes the first printed circuit board 52 to be properly aligned with the electrical contacts 60 when the electrical connector 56 is mounted to the first printed circuit board 52. In this regard, it should be appreciated that the first printed circuit board 52 includes a complementary polarization member and alignment guide that are each configured to engage the polarization member and alignment guide of the electrical connector 56. In accordance with the illustrated embodiment, the polarization member and alignment guide of the first printed circuit board 52 are provided by the slot 109 that extends longitudinally into the leading edge 90. However, the polarization member and the alignment guide of both the electrical connector 56 and the first printed circuit board 52 can alternatively be provided as two separate members that are spaced apart from each other if desired.

Referring again to FIGS. 2B and 3, before or after the electrical connector 56 has been mounted to the first printed circuit board 52, an edge card, such as the second printed circuit board 54, can be removably mated with the electrical connector 56. In particular, the electrical connector 56 can be attached to the second printed circuit board 54 by imparting a relative longitudinal motion on at least one of the electrical connector 56 and second circuit board 54 such that the mating interface 64 of the electrical connector 56 receives the leading edge 91 of the second printed circuit board 54 along a longitudinal insertion direction until the electrical contacts 60 engage the contact pads 88.

The connector housing 58 can include a second polarization member in the form of a polarization wall 115 that extends between the upper end 72 and the lower end 74 at a location laterally between the signal contacts 61 and the power contacts 63 at the mating end 64. The polarization wall 115 is thus disposed at a location offset with respect to a laterally central location of the housing body 59. The second printed circuit board 54 can define a slot 111 that extends in from the leading edge 91 and is sized so as to receive the polarization wall 115, thereby ensuring that the second printed circuit board 54 is properly oriented for connection to the electrical connector 56. In particular, when the electrical connector 56 is mated with the second printed circuit board 54, select ones of the electrical pads 88 can engage the signal contacts 61, and select ones of the electrical pads 88 can engage the power contacts 63.

It is recognized that when mating the second printed circuit board 54 to the electrical connector 56, angular or directional misalignments between the leading edge 91 of the second printed circuit board 54 and the chamber 76 of the housing body 59 can apply stress to the electrical contacts 60, which in turn applies stress to the solder connection between the electrical contacts 60 and the electrical pads 86 of the first printed circuit board 52. For instance, when the second printed circuit board 54 is misaligned with the connector housing 58 as the second printed circuit board 54 is inserted into the chamber 76, insertion forces can be translated to the electrical contacts 60 and thus to the solder connection that attaches the electrical contacts 60 to the contact pads 86 of the first printed circuit board 52.

Accordingly, as described above, conventional straddle mount connectors include a pair of mounting ears 44 that secure the first printed circuit board 24 to the connector housing 58 (see FIG. 1) so as to prevent the mating forces from biasing the electrical connector 22 into movement with respect to the first printed circuit board 24, which could affect the integrity of the solder connection between the electrical contacts 32 and the contact pads of the first printed circuit board 52. However, the mounting ears 44 occupy valuable real estate on the first printed circuit board 24. Furthermore, it is recognized that because the electrical signal contacts 61 are thinner than the power contacts 63, the mating stresses are more likely to affect the integrity of the solder connection between the electrical signal contacts 61 and the contact pads 86 of the first printed circuit board 52 as compared to the solder connection between the electrical power contacts 63 and the contact pads 86 of the first printed circuit board 52.

Figure 9B:
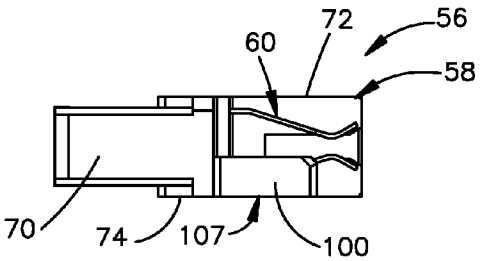
FIGS. 9A-B are side elevation views of the electrical connector illustrated in FIG. 2.
Figure 9A:
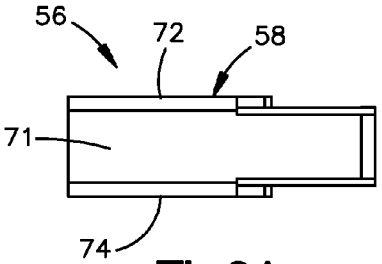

Accordingly, as illustrated in FIGS. 2A and 9B, the connector housing 58 of the electrical connector 56 includes only one mounting fastener 107 that is configured to secure the connector body 59, and thus the connector housing 58, and thus the electrical connector 56, to the first printed circuit board 52. For instance, the mounting fastener 107 is configured to secure the connector housing 58 to the first printed circuit board 52 so as to prevent relative movement between the first printed circuit board 52 and the connector housing 58 along the longitudinal direction, including the insertion direction, and further along the lateral and transverse directions. Thus, it can be said that the mounting fastener 107 is configured to secure the connector housing 58 to the first printed circuit board 52 so as to prevent relative movement between the first printed circuit board 52 and the connector housing 58 along a direction that is parallel to the plane in which the first printed circuit board 52 extends, which can be defined by the longitudinal and lateral directions. Accordingly, the mounting fastener 107 is configured to securely fasten the connector housing 58 to the first printed circuit board 52 so as to absorb the forces that are generated as the second printed circuit board 54 is mated with the electrical connector 56, for instance due to angular or directional misalignments between the leading edge 91 of the second printed circuit board 54 and the connector housing 58. The absorption of the generated forces by the connection between the connector housing 58 and the first printed circuit board 52 reduces the forces applied to the electrical signal contacts 61.

The mounting fastener 107 can be configured as a mounting ear 100 that extends laterally out from one of the side walls of the housing body 59. As illustrated, the mounting ear 100 is disposed adjacent to the side wall 70 that is adjacent the electrical signal contacts 61 so as to securely fasten the connector housing 58 to the first printed circuit board 52 at a location adjacent the electrical signal contacts 61. For instance, the mounting ear 100 can extend laterally outward with respect to the side wall 70, and is positioned adjacent the electrical signal contacts 61 such that the electrical signal contacts 61 are disposed laterally between the mounting ear 100 and the electrical power contacts 63. In accordance with the illustrated embodiment, the electrical connector 56 is devoid of a mounting ear adjacent to the side wall 71 that is disposed adjacent the electrical power contacts 63. Accordingly, the electrical power contacts 63 are not disposed laterally between the electrical signal contacts 61 and a mounting fastener that is configured to secure the electrical connector 56 to the first printed circuit board 52.

Thus, the electrical connector 56 includes the mounting fastener 107 that is disposed closer to the electrical signal contacts 61 than the electrical power contacts 63, and is devoid of a second mounting fastener that is 1) configured to secure the card-edge connector to the first substrate and 2) is disposed closer to the electrical power contacts than the electrical signal contacts.

In accordance with the embodiment as illustrated in FIGS. 2A-4, the mounting ear 100 includes a body 102 and defines a mounting aperture 104 that extends through the body 102. The first printed circuit board 52 can include a first complementary mounting aperture 113 (see FIG. 2B) that is aligned with the mounting aperture 104, which can define a second mounting aperture, when the electrical connector 56 is mounted to the first printed circuit board 52, such that an attachment member 55 such as a bolt can extend through the mounting apertures 104 and 113, and a nut 57 can be fastened to the bolt so as to tightly secure the housing 58 against the first printed circuit board 52. The body 102 can be configured to abut the top surface 96 of the first printed circuit board 52 as illustrated, or alternatively can be configured to abut the bottom surface 98 of the first printed circuit board 52 as desired, when the electrical connector 56 is mounted to the first printed circuit board 52.

Figure 10:
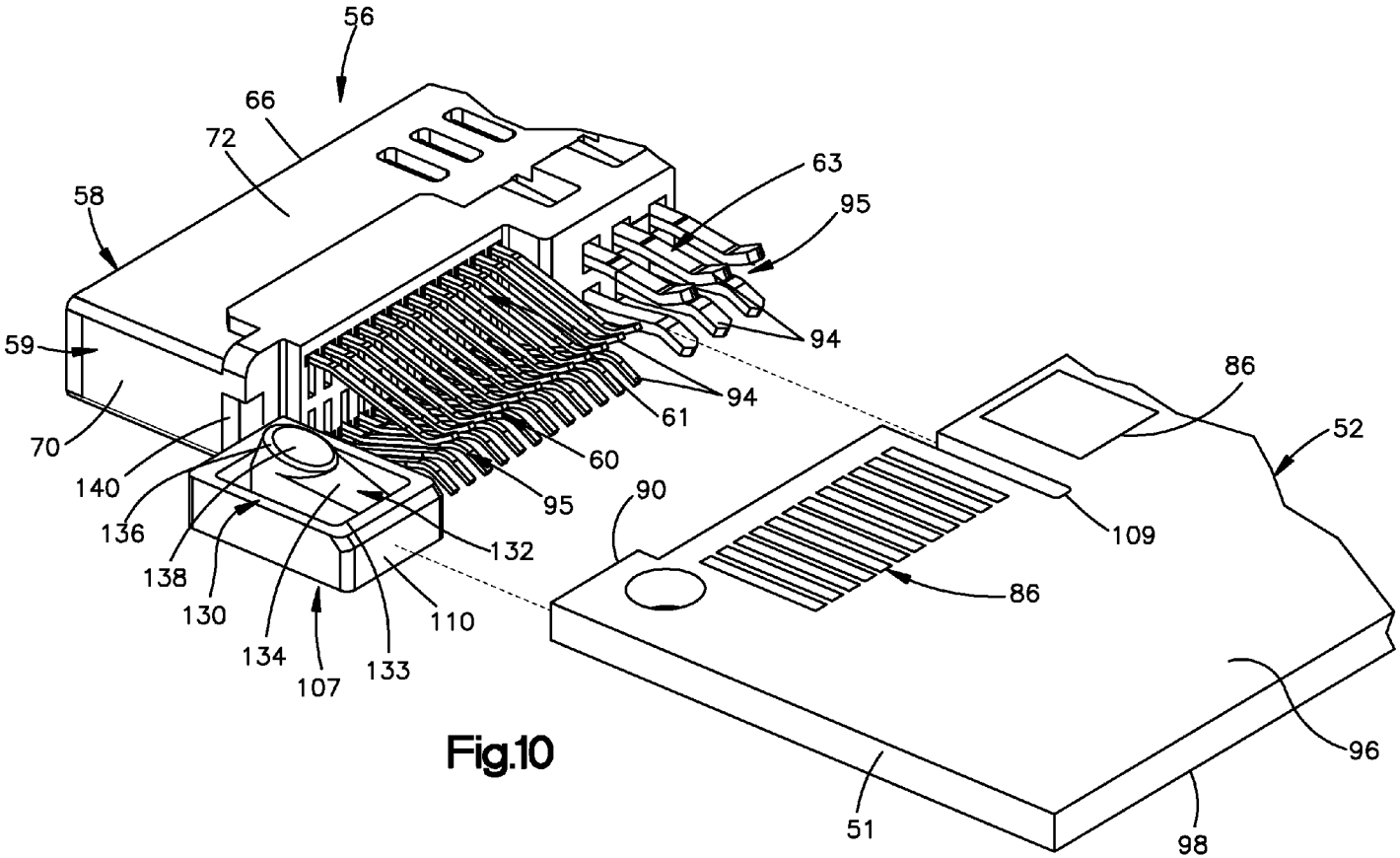
FIG. 10 is a perspective view of a portion of an electrical connector as illustrated in FIG. 2A, but including a mounting fastener constructed in accordance with an alternative embodiment, showing the electrical connector aligned to be mounted to a printed circuit board.

It should be appreciated that the mounting fastener 107 that can be constructed in accordance with any suitable alternative embodiment that is configured to secure the first printed circuit board 52 to the connector housing 58 so as to absorb forces generated as the second printed circuit board 54 is mated to the electrical connector 56. For instance, the mounting fastener 107 can include a latch member that defines an attachment member configured to secure the mounting fastener 107, and thus the electrical connector, to the first printed circuit board 52. For instance, as illustrated in FIG. 10, the mounting ear 110 can include a support surface 130 and a latch member 132 that can be resilient and carried by the support surface 130. The latch member 132 is configured to interlock with a complementary engagement member of the first printed circuit board 52. For instance, the latch member 132 is configured to extend into the mounting aperture 113 so as to secure the electrical connector 56 to the first printed circuit board 52. Furthermore, as illustrated in FIG. 10, the connector housing 58 can be devoid of the polarization wall 101 as illustrated in FIG. 4.

Each latch member 132 includes a flexible latch arm 134 that is connected to the mounting ear 110 at a proximal end, defines an opposed distal free end that carries a latch body that is illustrated as a post 136 but could have any suitable alternatively configuration as desired, such as a hook. Thus, it can be said that the latch body, such as the post 136, is supported or carried by the connector housing 58. The mounting ear 110 defines a transverse aperture 133 extending therethrough, such that the latch arm 134 and the post 136 can be at least partially disposed in the aperture 133. The latch arm 134 can be mounted to the leading end of the mounting ear 110 with respect to the direction of insertion toward the first printed circuit board 52, and can be flexible in and out of the aperture 133 as desired.

Thus, the latch arm 134 extends along a direction opposite the insertion direction of the electrical connector 56 toward the first printed circuit board 52, such that the distal free end that carries the latch body, such as the post 136, is disposed opposite the proximal end along the direction that is opposite the insertion direction. In accordance with the illustrated embodiment, the post 136 is substantially cylindrical and extends up from the latch arm 134, for instance at the distal free end, and defines an engagement surface 138 that can define an upper engagement surface that is configured to ride along the bottom surface 98 of the first printed circuit board 52. The engagement surface 138 can be beveled such that the leading end of the engagement surface 138 is disposed below the trailing end of the engagement surface 138 with respect to the direction of insertion toward the first printed circuit board 52. Otherwise stated, the engagement surface 138 is tapered transversely inward or down along a direction from the trailing end toward the leading end.

It can thus be said that the engagement surface 138 defines a leading end and an opposed trailing end along the insertion direction toward the first printed circuit board 52. The engagement surface 138 can be tapered along the insertion direction as illustrated. Accordingly, before the electrical connector 56 is mounted to the first printed circuit board 52, the leading end of the engagement surface 138 is disposed on a first side of a plane defined by the surface of the first printed circuit board 52 that the engagement surface 138 rides along when mounting the electrical connector 56 to the first printed circuit board 52 (e.g., the lower surface 98), and the trailing end of the engagement surface 138 is disposed on a second opposite side of the plane. For instance, the leading end of the engagement surface 138 is located on the same side of the plane defined by the lower surface 98 of the first printed circuit board 52, whereas the trailing end of the engagement surface 138 is disposed on the opposite side of the plane defined by the lower surface 98. As the electrical connector 56 is mounted to the first printed circuit board 52, the trailing end of the engagement surface 138 is biased by the first printed circuit board 52 across the plane to the first side of the plane, such that the trailing end rides along the surface of the first printed circuit board 52 that defines the plane (e.g., the lower surface 98). It should be appreciated that the plane can alternatively be defined by the top surface 96 of the first printed circuit board 52 as desired. The housing body 59 can further define a support recess 140 that has a transverse dimension sized to receive the leading edge 90 of the first printed circuit board 52.

During operation, when the electrical connector 56 is mounted to the first printed circuit board 52, the support surface 130 of the latch ear 110 may be substantially flush with and abut the bottom surface 98 of the first printed circuit board 52. The latch arm 134 may be flexible and resilient when pressure is applied to the post 136 in the upward or downward direction. Accordingly, the latch member 132, and in particular the latch arm 134, can flex between a relaxed or unflexed position and a flexed position, whereby the post 136 is displaced transversely down as the latch arm 134 flexes. When the latch member 132 is in the relaxed position, the latch member 132 and/or a portion of the post 136 may be disposed above the support surface 130. For instance, a first leading portion of the engagement surface 138 can be disposed below the support surface 130, while a second trailing portion of the engagement surface 138 can be disposed above the support surface 130 when the latch member 132 is in the relaxed position. Thus, when the latch member 132 is in its relaxed position, at least a portion of the engagement surface 138 is disposed above the bottom surface 98 of the first printed circuit board 52 when the first printed circuit board 52 is aligned with the gap 95 between the prongs 94 of the electrical contacts 60.

When a biasing force is applied to the post 136 in the downward direction, for instance, the latch member 132, and in particular the latch arm 134, iterates to the flexed position, whereby the post 136, and thus the engagement surface 138, is displaced so as to be transversely recessed with respect to the relaxed position. For instance, when in the flexed position, a substantial entirety of the engagement surface 138, including the trailing end, is substantially flush with and/or disposed below the support surface 130 of the latch ear 110, and thus below the bottom surface 98 of the first printed circuit board 52 as the electrical connector 200 is mounted to the first printed circuit board 52. Otherwise stated, when the latch member 132 is in the flexed position, a substantial entirety of the engagement surface 138, including the trailing end, is disposed in the transverse aperture 133, and does not extend above the support surface 130 of the latch ear 110. When the biasing force is released, the latch arm 134 is biased to flex back upward, thereby applying a biasing force to the post 136 that urges the post 136 to its secured position in the aperture 113 of the first printed circuit board 52 when the latch member 132 is in the neutral position. Thus, the latch member 132 prevents the first printed circuit board 52 from translating relative to the electrical connector 56 along the lateral and longitudinal directions that define the plane of the first printed circuit board 52. Furthermore, the support recess 140 is dimensioned such that the housing body 59 prevents the leading edge 98 of the first printed circuit board 52 from translating relative to the electrical connector 56 along the transverse direction that is substantially perpendicular to the plane defined by the first printed circuit board. The latch member is further described in U.S. patent application Ser. No. 12/967,364 filed on Dec. 14, 2010, the disclosure of which is hereby incorporated by reference as if set forth in its entirety herein.

The electrical connector 56 can thus include the mounting fastener 107 disposed proximate to one of the side walls 70 and 71, and can further include a mounting guide 110 that is disposed proximate to the opposed other of the side walls 70 and 71. For instance, the mounting guide 110 can be carried by the side wall 71 that is opposite the side wall 70 that is disposed adjacent to the mounting fastener 107. The mounting guide 110 includes a channel 112 that is carried by and defined by a laterally inner surface 114 of the side wall 71. The channel 112 is longitudinally elongate along a direction substantially parallel to the insertion direction, and extends laterally into the inner surface 114 of the side wall 71. The channel 112 has a transverse dimension or height substantially equal to that of the first printed circuit board 52 such that respective portions of the top surface 96 and bottom surface 98 can be captured in the channel 112. The transverse dimension or height of the channel 112 can be substantially equal to or greater than the transverse dimension or height of the gap 95 between the opposed prongs 94 of the electrical contacts 60. Accordingly, a straight line, such as a laterally extending line, that extends through the gap 95 can further extend into the channels 112 and 113. Furthermore, a straight line, such as a laterally extending line, that extends into the channels 112 and 113 can intersect at least one up to all of the electrical contacts 60, for instance the prongs 94, of one or both of the first and second rows of electrical contacts. Furthermore, the channel 112 defines a lateral depth in the inner surface 114 sufficient such that the first printed circuit board 52 can be substantially captured in the channel 112 when the mounting aperture 104 of the mounting fastener 107 is aligned with the corresponding aperture 113 of the first printed circuit board 52.

The first printed circuit board 52 can include laterally opposed side edges 51 and 53, such that the side edge 53 of the first printed circuit board 52 can be captured in the channel 112 and the side edge 51 that is disposed proximate to the mounting aperture 113 (e.g., spaced from the mounting aperture 113 by a distance that is less than the distance that the side edge 53 is spaced from the mounting aperture 113). The channel 112 can have a transverse height that is slightly greater than that of the first printed circuit board 52 so that the edge 53 can be received in the channel 112, but small enough such that the mating forces between the second printed circuit board 54 and the electrical connector 56 are prevented from biasing the electrical connector 56 into substantial movement with respect to the first printed circuit board 52, it being appreciated that movement could tend to crack the solder connection between the electrical contacts 60 and the contact pads 86, or otherwise jeopardize the integrity of the solder connection between the electrical contacts 60 and the contact pads 86. The channel 112 can have a longitudinal length as desired to reliably capture the side edge 53 therein, such that the side edge 53 is sufficiently limited with respect to vertical movement within the channel 112. The channel 112 can be laterally aligned with the middle portion 105 of the polarization wall 101 of the electrical connector 56, thereby further facilitating insertion of the leading edge 90 into the gap 95 of the electrical contacts 60 when the electrical connector 56 is mounted to the first printed circuit board 52. The channel 112 can be defined as a recess that extends laterally into the inner surface 114, or can alternatively be defined between a pair of transversely spaced projections that extend laterally inward from the inner surface 114.

Figure 1:
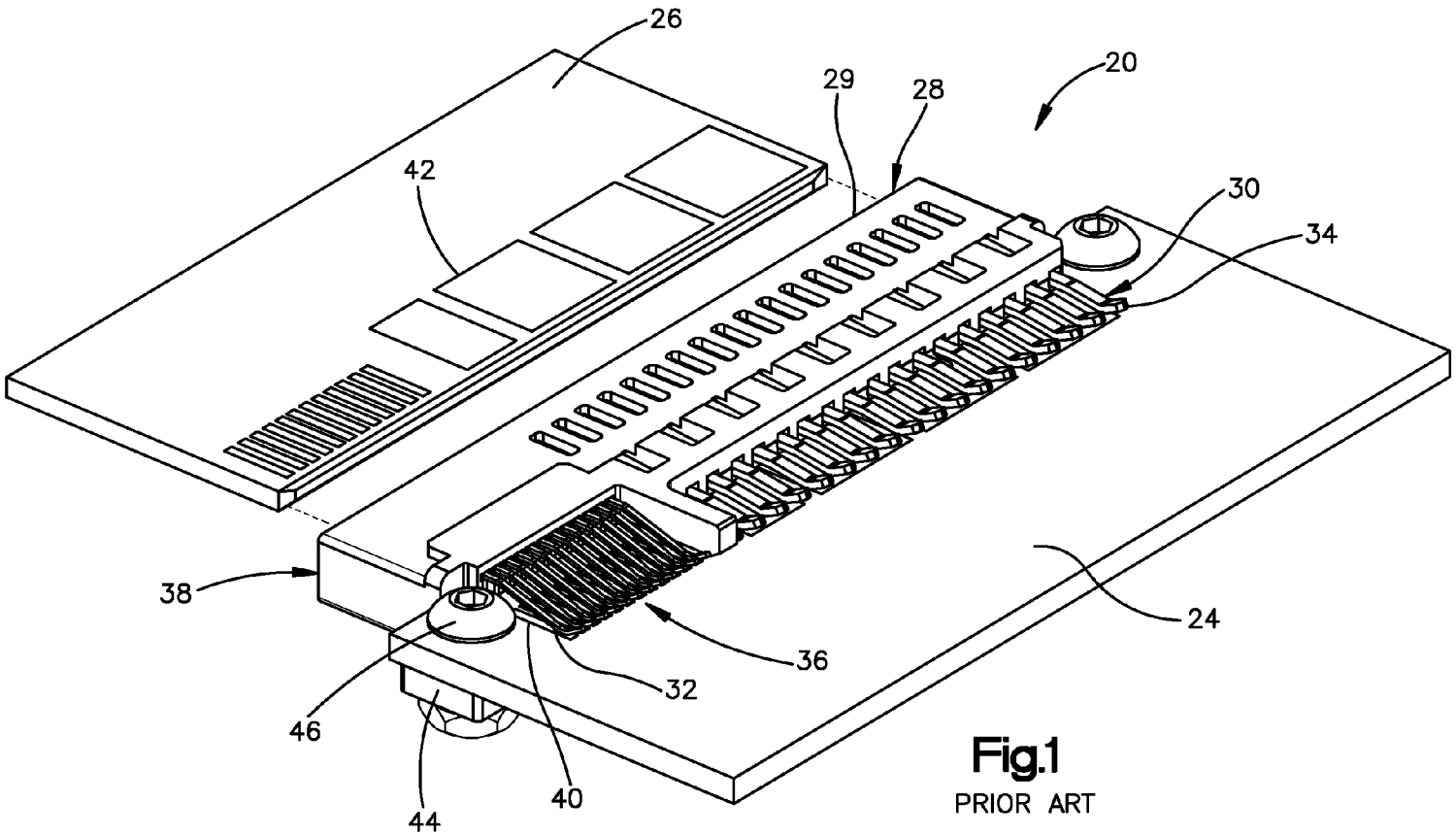
Fig.1 PRIOR ART
FIG. 1 is a perspective view of a conventional straddle-mount card-edge connector connected between a pair of circuit boards.

Because the electrical connector 56 includes only one mounting fastener 107 that projects laterally out from a side of the housing body 59, the electrical connector 56 can define a reduced lateral dimension with respect to conventional straddle mount connectors that include a pair of mounting fasteners 107 that extend out from both sides of the housing body, such as the connector 22 illustrated in FIG. 1. Thus, the electrical connector 56 occupies less space on the first printed circuit board 52 when the connector 56 is mounted onto the first printed circuit board, with respect to the electrical connector 22 illustrated in FIG. 1. At the same time, the mounting fastener 107 is disposed proximate to the electrical signal contacts 61 that are thinner than the electrical power contacts 63. That is, the mounting fastener 107 is disposed closer to the electrical signal contacts 61 than the electrical power contacts 63. Furthermore, the first side wall 70 is spaced closer to the electrical signal contacts 61 than the electrical power contacts 63.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims

What is claimed:

1. A card-edge connector configured to receive a first substrate having a first mounting aperture, the card-edge connector comprising:

a connector housing including a housing body that includes a first side wall and a second side wall that each define respective exterior surfaces that face away from each other, the connector housing carrying a plurality of electrical contacts, the electrical contacts defining a mounting end configured to be electrically connected to the first substrate, and an opposed mating end configured to be electrically connected to a second substrate;

a mounting fastener configured to engage the first mounting aperture; and a mounting guide formed in the housing body and elongate along a first direction, the mounting guide configured to receive a side edge of the first substrate that is planar along the first direction and a second direction that is perpendicular to the first direction, when the card-edge connector is mounted to the first substrate along the first direction, wherein the mounting fastener extends out from the exterior surface of one of the first and second side walls such that the exterior surface of the one of the first and second side walls is disposed between the mounting fastener and the mounting guide along the second direction.

2. The card-edge connector as recited in claim 1, wherein the electrical contacts comprises a plurality of signal contacts and a plurality of power contacts.

3. The card-edge connector as recited in claim 1, wherein the signal contacts each have a thickness less than that of the power contacts.

4. The card-edge connector as recited in claim 1, wherein the mounting fastener is disposed closer to the signal contacts than the power contacts.

5. The card-edge connector as recited in claim 1, wherein the mounting fastener defines a second mounting aperture configured to be placed in alignment with the first mounting aperture, such that an attachment member is configured to extend through the first and second mounting apertures so as to mount the card-edge connector to the first substrate.

6. The card-edge connector as recited in claim 5, wherein the mounting fastener further comprises a latch member that extends into the first mounting aperture.

7. A card-edge connector configured to receive a first substrate having a first mounting aperture, the card-edge connector comprising:

a connector housing that carries a plurality of electrical contacts, the connector housing defining a mounting interface configured to mount to the first substrate, a mating interface configured to mate with a second substrate, the connector housing including a housing body that defines a first side wall that extends between the mating interface and the mounting interface, a second side wall opposite the first side wall, the second side wall extending between the mating interface and the mounting interface; and a mounting fastener disposed closer to the first side wall than the second side wall, the mounting fastener configured to secure the card-edge connector to the first substrate with respect to relative movement between the first substrate relative and the card-edge connector; wherein the card-edge connector is devoid of a second mounting fastener that is 1) disposed closer to the second side wall than the first side wall and 2) configured to attach to the first substrate through an aperture of the first substrate.

8. The card-edge connector as recited in claim 7, further comprising a mounting guide configured to receive a side edge of the first substrate when the mounting fastener engages the mounting aperture.

9. The card-edge connector as recited in claim 8, wherein the mounting guide comprises a channel defined by the second side wall.

10. The card-edge connector as recited in claim 7, wherein the electrical contacts include a plurality of electrical signal contacts and a plurality of electrical power contacts.

11. The card-edge connector as recited in claim 10, wherein the electrical signal contacts are thinner than the electrical power contacts, and the first side wall is spaced closer to the electrical signal contacts than the electrical power contacts.

12. The card-edge connector as recited in claim 7, wherein the mounting fastener further comprises a latch member that extends into the first mounting aperture.

13. A card-edge connector configured to receive a first substrate having a first mounting aperture, the card-edge connector comprising:

a connector housing that includes a first side wall and second side wall opposite the first side wall, the connector housing supporting a plurality of electrical signal contacts and a plurality of electrical power contacts between the first and second side walls, wherein the electrical signal contacts are thinner than the electrical power contacts, the connector housing defining a mounting interface configured to mount to the first substrate such that the electrical signal contacts and the electrical power contacts are soldered to the first substrate, and a mating interface configured to removably mate with a second substrate;

a mounting fastener disposed adjacent to one of the first and second side walls and closer to the electrical signal contacts than the electrical power contacts, the mounting fastener configured to engage the mounting aperture so as to secure the electrical connector to the first substrate, wherein the card-edge connector is devoid of a second mounting fastener that is 1) configured to secure the card-edge connector to the first substrate and 2) is disposed closer to the electrical power contacts than the electrical signal contacts, wherein 1) the other of the first and second side walls carries a mounting guide configured to receive a first side edge of the first substrate when the card-edge connector is mounted to the first substrate, and 2) the card-edge connector is devoid of a second mounting guide that is configured to receive a second side edge of the first substrate that is opposite the first side edge of the first substrate when the card-edge connector is mounted to the first substrate.

14. The card-edge connector as recited in claim 13, wherein the connector housing includes a first and second opposed side walls, the mounting fastener is disposed adjacent to one of the side walls, and the other side wall carries a mounting guide configured to receive a side edge of the first substrate when the card-edge connector is mounted to the first substrate.

15. The card-edge connector as recited in claim 13, wherein the mounting fastener further comprises a latch member that extends into the first mounting aperture.

16. The card-edge connector as recited in claim 1, wherein the mounting guide and the electrical contacts along the mounting end both extend beyond the mounting fastener along the first direction.

17. The card-edge connector as recited in claim 7, further comprising a polarization wall disposed laterally between the first side wall and the second side wall, the polarization wall extending from the mating end.

18. The card-edge connector as recited in claim 13, further comprising a polarization wall disposed at a location laterally between the signal contacts and the power contacts, the polarization wall extending transversely between an upper end and a lower end of the housing body at the mating interface.

* * * * *